United States Patent [19]

Brinkman

[11] 4,338,904

[45] Jul. 13, 1982

[54] DEVICE FOR DISTRIBUTING FUEL TO A COMBUSTION ENGINE

[75] Inventor: Willem Brinkman, Velp, Netherlands

[73] Assignee: Holec N.V., Utrecht, Netherlands

[21] Appl. No.: 87,719

[22] Filed: Oct. 24, 1979

[30] Foreign Application Priority Data

Oct. 25, 1978 [NL] Netherlands ..... 7810629

[51] Int. Cl.[3] ..... F02M 39/02

[52] U.S. Cl. ..... 123/499; 123/504; 417/410; 417/418

[58] Field of Search ..... 123/497, 499, 504; 417/410, 413, 415, 418, 534; 92/13, 13.5, 13.7, 13.1

[56] References Cited

U.S. PATENT DOCUMENTS 4,120,617 10/1978 Brinkman ..... 123/503

4,164,920 8/1979 Brinkman ..... 123/499

4,195,609 4/1980 Brinkman ..... 123/499

4,210,117 7/1980 Brinkman ..... 123/497

*Primary Examiner*—Charles J. Myhre

*Assistant Examiner*—Magdalen Moy

*Attorney, Agent, or Firm*—Diller, Ramik & Wight

[57] ABSTRACT

A device for distributing fuel to a combustion engine provided with two or more fuel pumps which are electromagnetically driven, the stroke of said fuel pumps being bounded by an adjustable stop bearing on a fixed stop support.

In order to avoid variation of the adjusted pump displacements due to the frequent, heavy impacts which are exerted by the armature of electro-magnets through the stop member on the stop support, the stop support forms part of a firm monolith, while also other pump parts form part of said firm monolith.

11 Claims, 16 Drawing Figures

Figure 1:
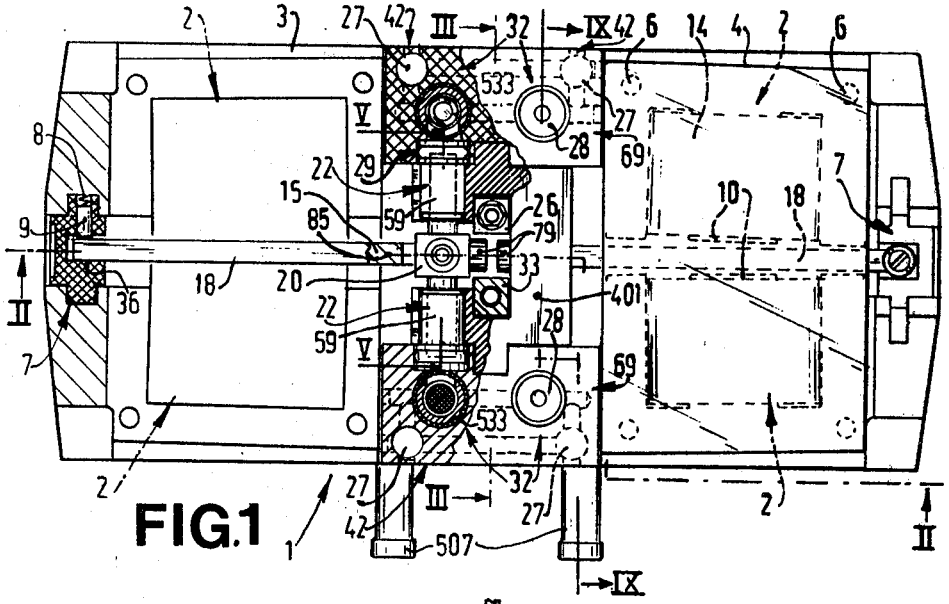

FIG.5
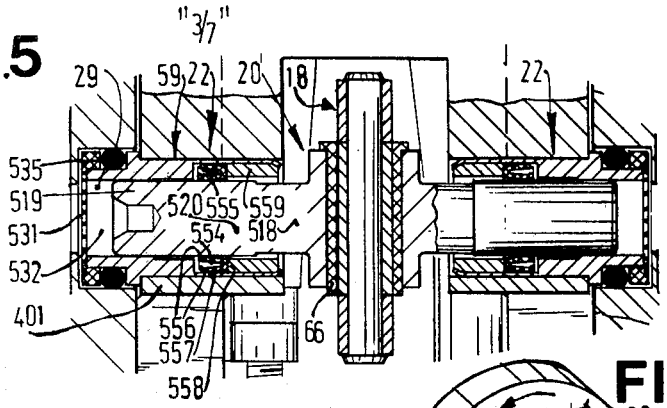
FIG.8
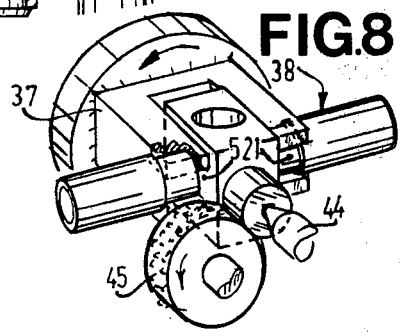
FIG. 6
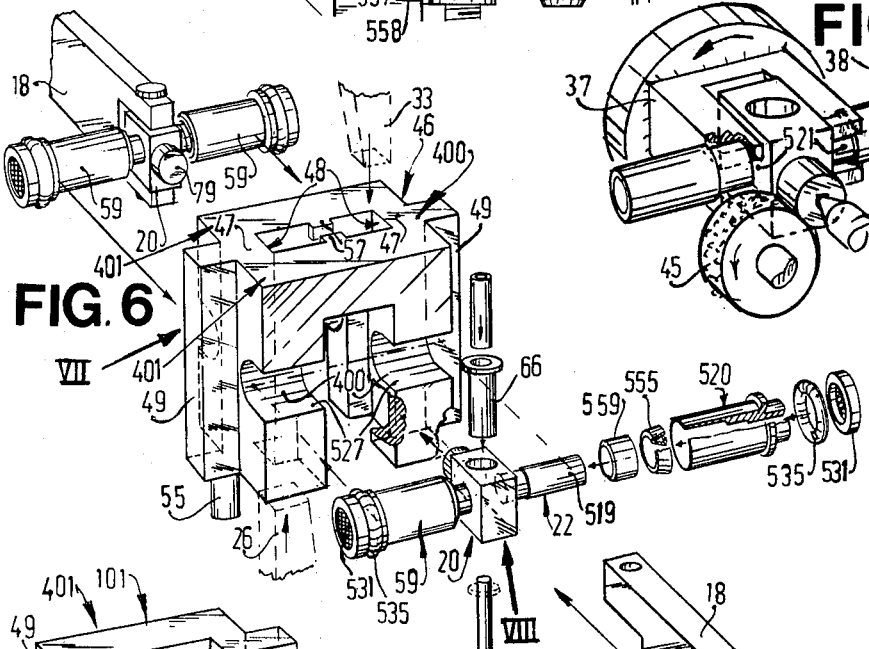
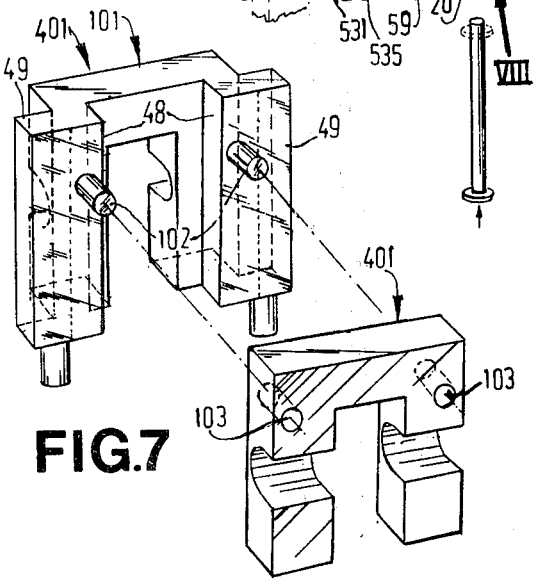
FIG.7

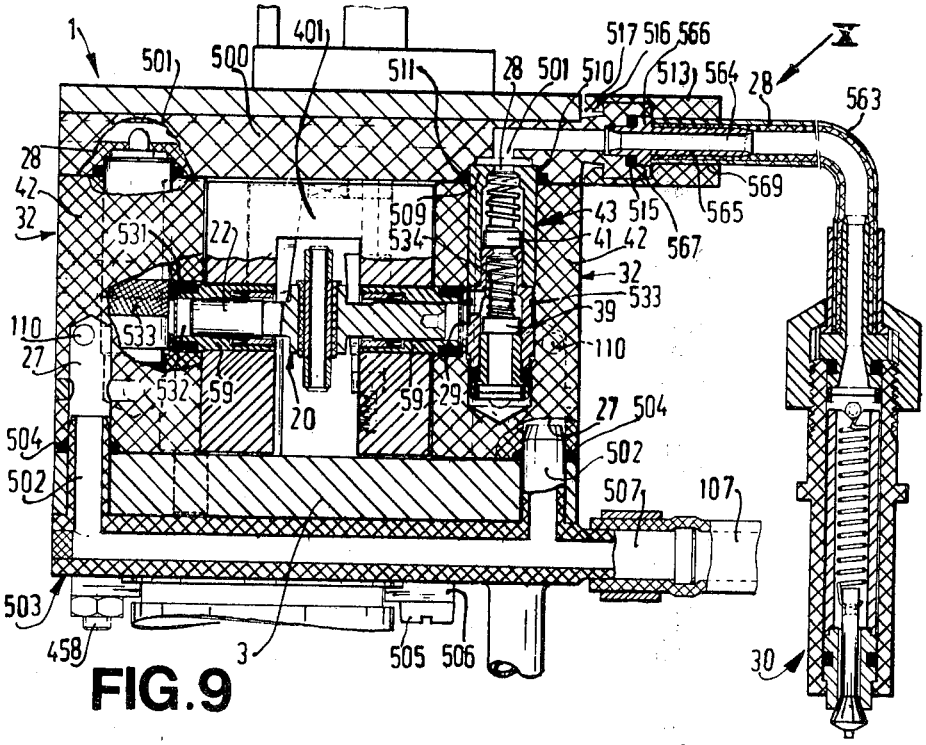
FIG.9
FIG.10
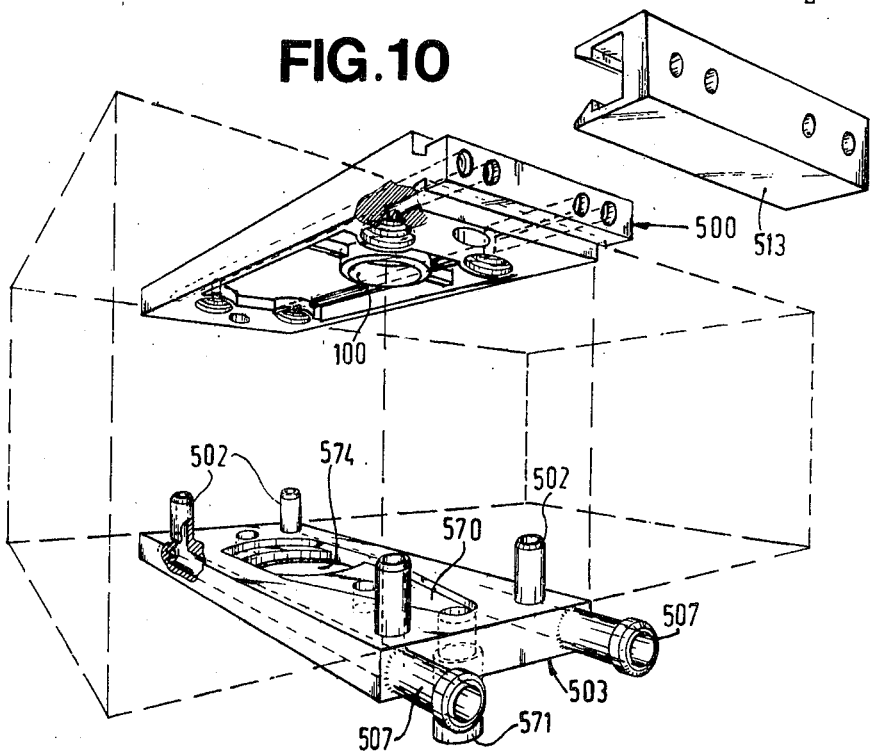

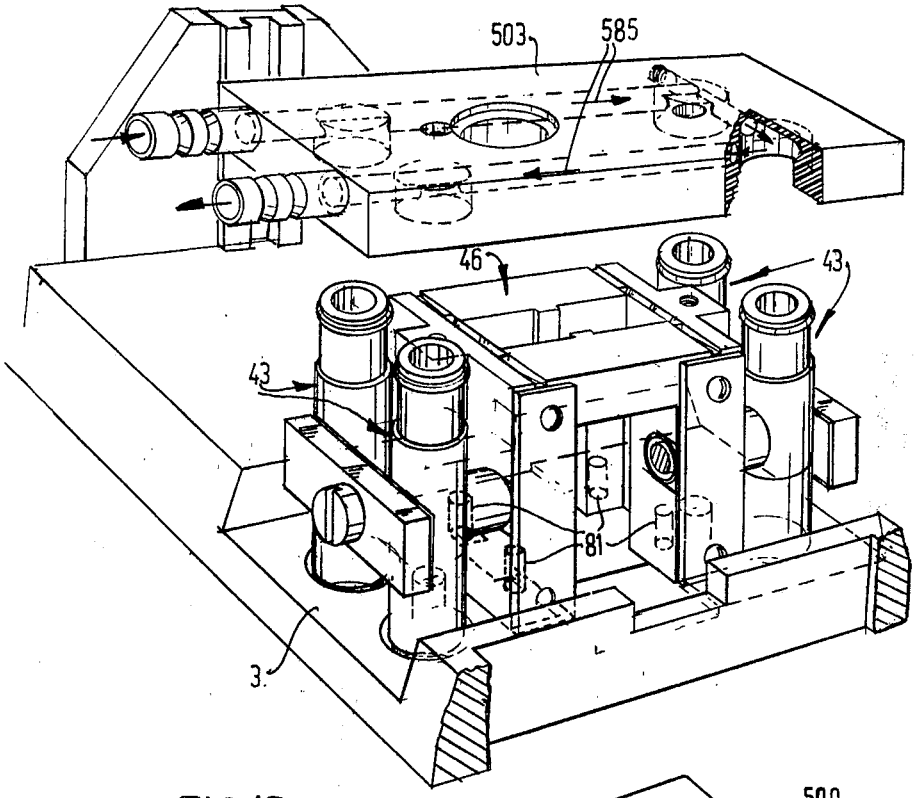
FIG.15
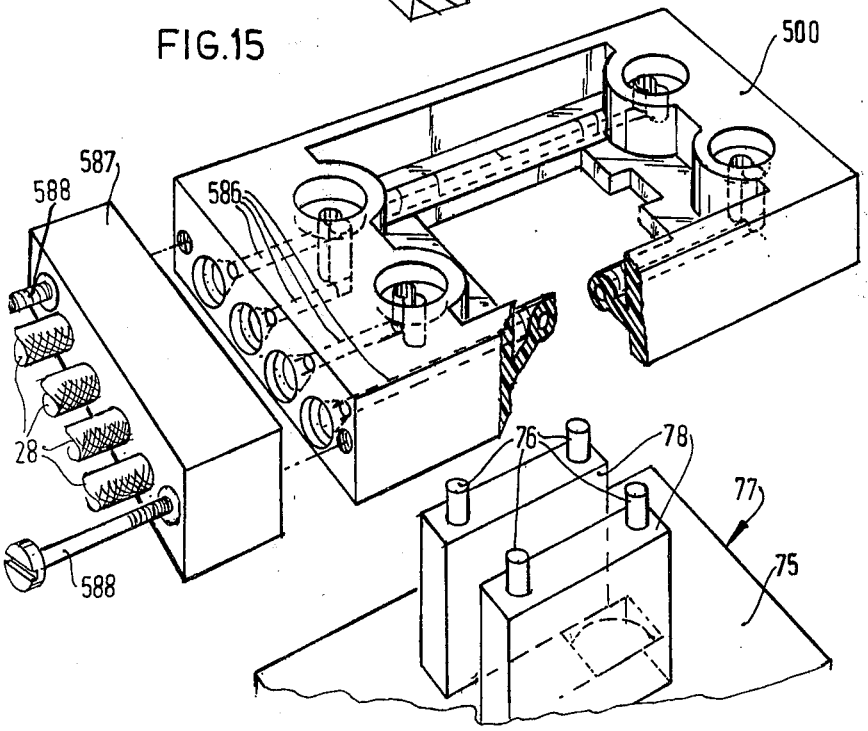

DEVICE FOR DISTRIBUTING FUEL TO A COMBUSTION ENGINE

The invention relates to a device for distributing fuel to a combustion engine, in which a pump chamber of a first fuel pump and a pump chamber of a second fuel pump are arranged coaxially at a distance from one another, can each be connected through an inlet valve with a fuel inlet and through a fuel outlet with an atomizer of the combustion engine and are bounded by a displacer body reciprocatorily driven by driving means, the displacer bodies being intercoupled by means of a coupling member arranged between the two fuel pumps and having stop means co-operating with at least one adjustable stop, which bears on a fixed stop support, the fuel chambers being bounded by pump sleeves arranged in coaxial bores in the two ends of a bridge piece, the two ends of which are interconnected by at least one intermediate piece.

A device of the kind set forth is proposed in Dutch patent application No. 7801104. Herein the stop supports form parts of pump housings, to which the bridge piece is fastened. Each bridge piece should be accurately orientated with respect to the pump housings and the device has to be constructed solidly in order to avoid variation of the adjusted pump displacements due to the frequent, heavy impacts of the stop member on the stop supports.

The invention has for its object to simplify the manufacture and/or mounting of the device, whilst maintaining uniform deliveries of the fuel pumps. For this purpose the bridge piece and the stationary stop form part of one and the same monolith.

The monolith may, without any objection, have a complex shape, it is made from fritted metal.

According to the invention the monolith ensures the accurate relative alignment of the coaxial pump sleeves and a firm fixation of the stop supports frequently absorbing heavy impact forces with respect to the pump sleeves. If two fixed stop supports form part of the monolith, the monolith maintains the stop supports at an accurately predetermined distance from one another, whilst the monolith can maintain the supporting surfaces of the stop supports parallel to one another and constantly at right angles to the axial direction of the pump sleeves.

If the monolith is provided with aligning means for fixing the position of the stop support with respect to control-means for setting the stop, the monolith maintains, in addition, the stop support at a given place and in a given direction relative to said control-means.

A further simplification of the device is obtained, when a first bridge piece for the disposition of a first pair of coaxial pump sleeves and a second bridge piece for the disposition of a second pair of coaxial pump sleeves therein form part of one and the same monolith.

Since the alignment, proportioning and impact force absorption are brought about by the monolith, the pump housings may be made from synthetic resin or even a pump housing need not be provided on the bridge piece.

The monolith derives its firmness for an important part from its shape, if the monolith comprises two relatively spaced bridge pieces and two stop supports interconnecting the ends of the bridge pieces.

The device according to the invention is additionally simplified, when at least one coupling member together with two displacer bodies constructed in the form of plungers and a, preferably, cylindrical stop member forming the stop means are made in the form of a monolith of hard steel.

In order to obtain a simple device in which each pump delivers an accurately reproducible amount of fuel at a given setting of each adjustable stop, the pump chamber of each fuel pump is solely bounded by a pump sleeve accommodated in an end of a bridge piece with the displacer body movable therein and with a seal between said pump sleeeve and the displacer body and by a valve housing sealingly clamped to the pump sleeve, said housing having an inlet valve and an outlet valve.

In order to avoid disturbance of the set fuel displacement of the pump, the inlet valve of each fuel pump is preferably located above the outlet valve thereof.

In order to adjust as economically as possible the amount of fuel supplied to the combustion engine of a vehicle, that is to say, taking into account the different traffic conditions, for example, urban traffic and long roads without ground level crossings an adjustable stop is preferably provided to be set by mean of a control-element provided with an indicator and actuable from the driver seat of an automobile.

The above-mentioned and further features of the invention will be described more fully hereinafter with reference to a drawing.

The drawing shows in

Figure 2:
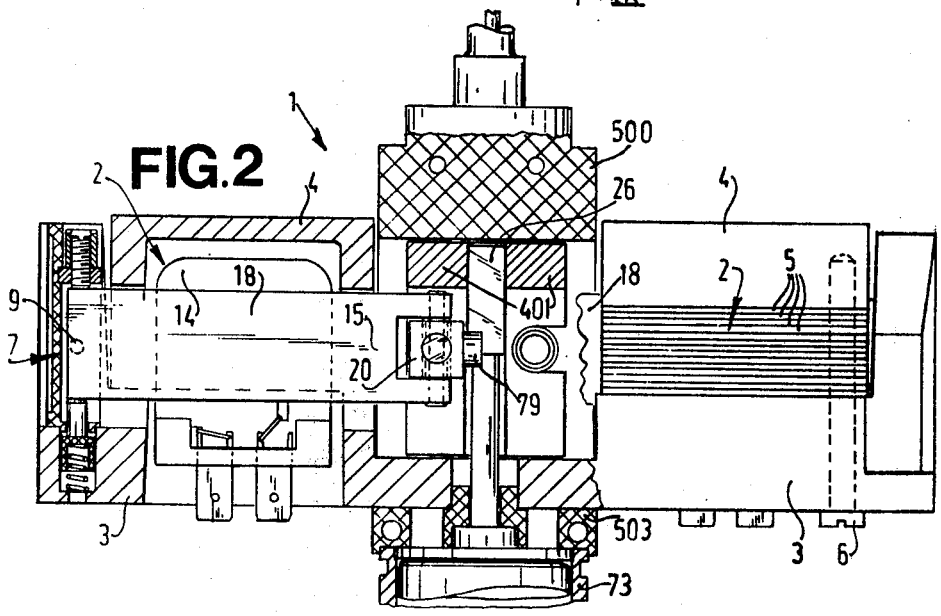
Figures 3, 4:
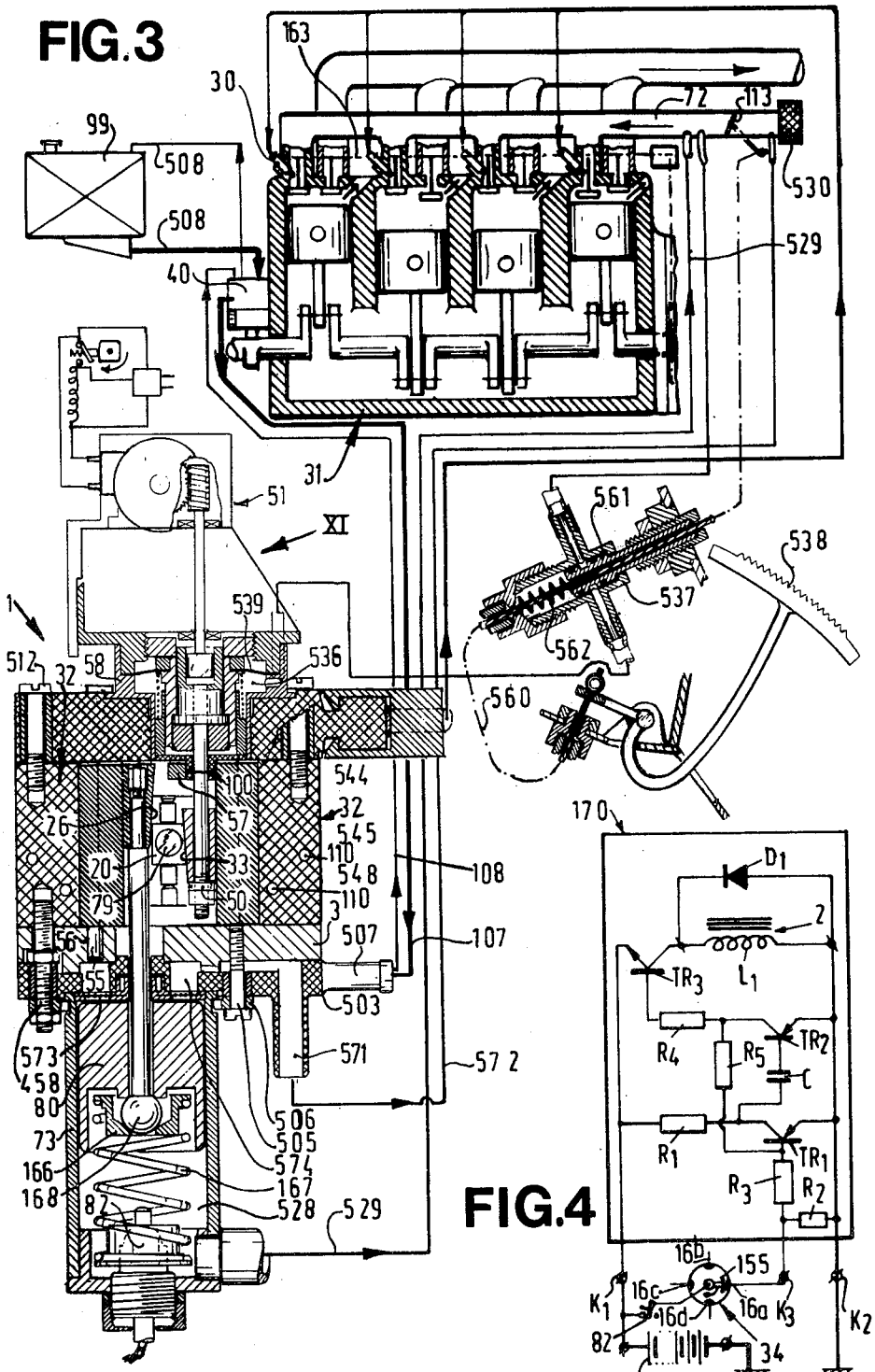
Figure 11:
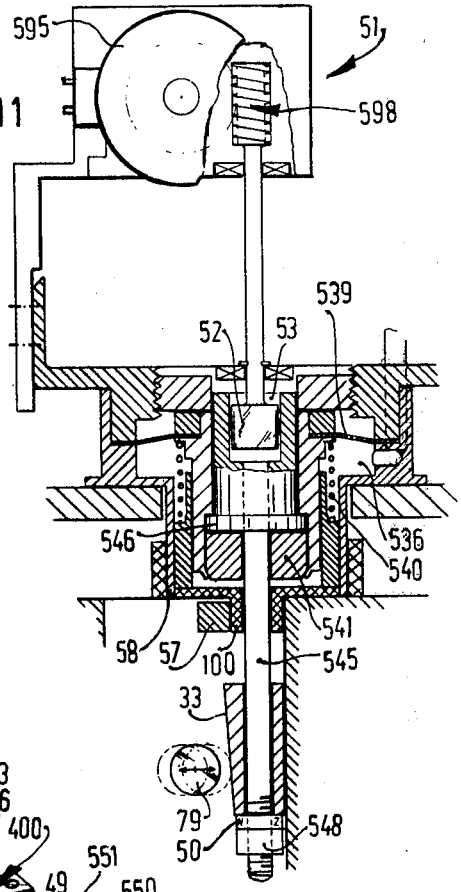
Figure 16:
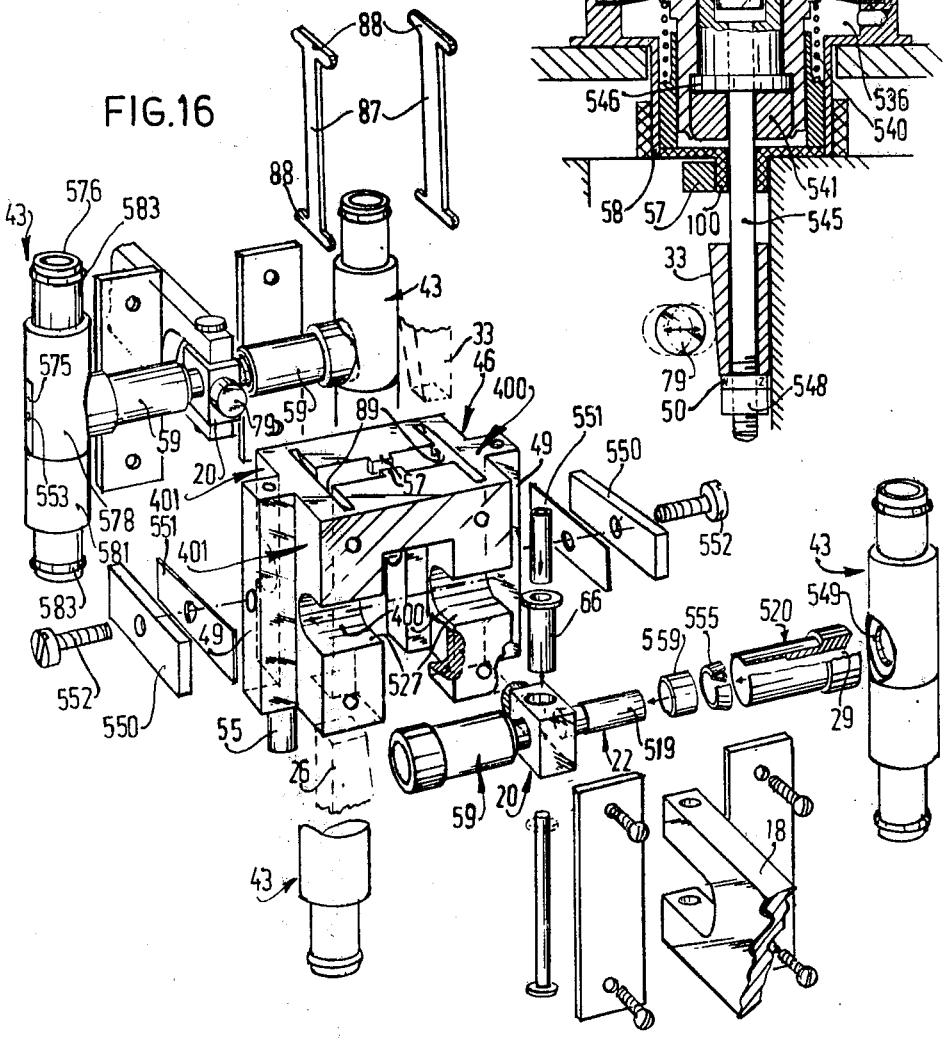
Figure 13:
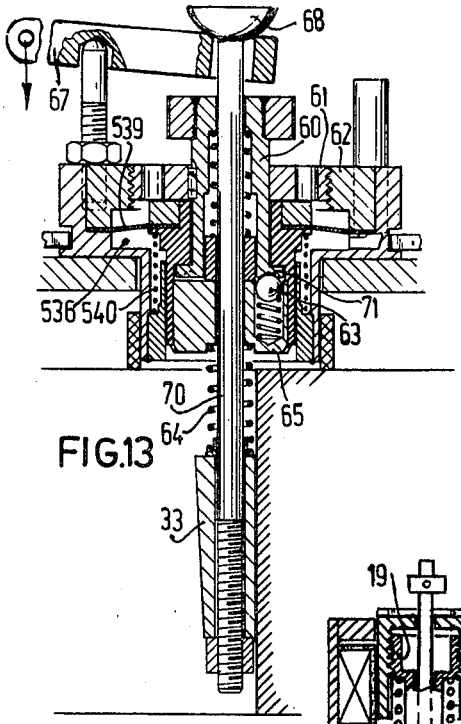
Figure 12:
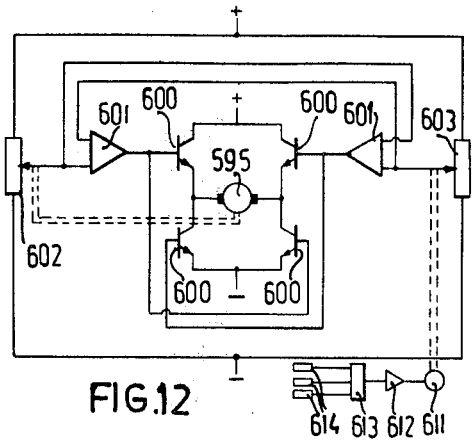
Figure 14:
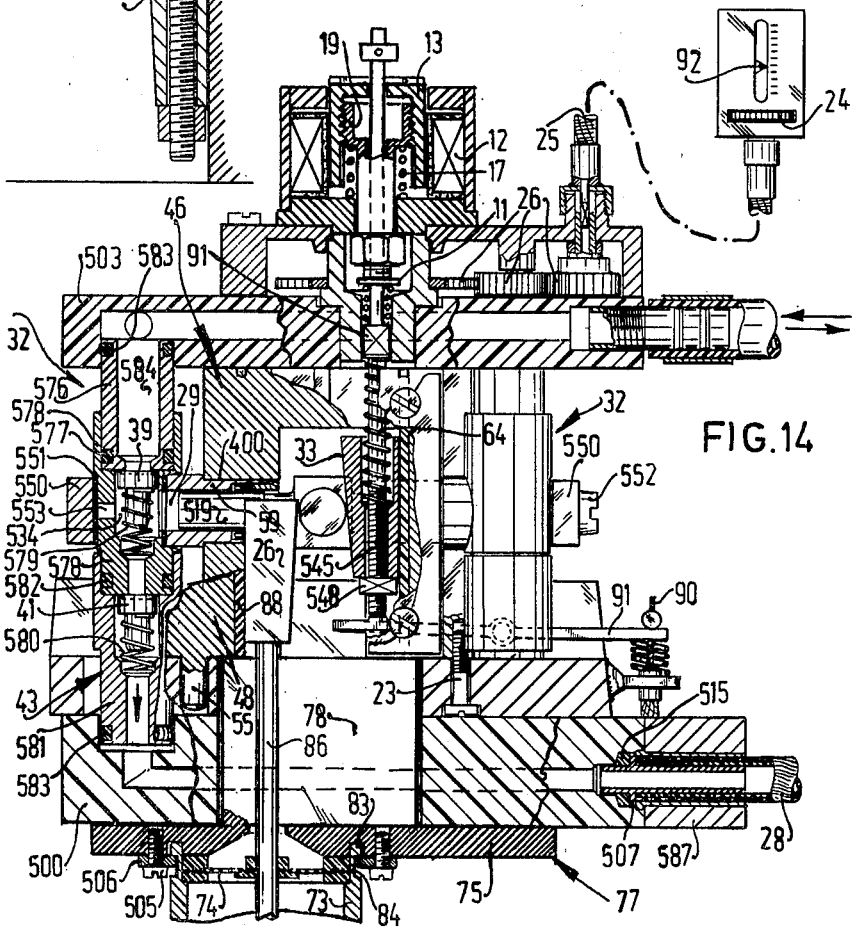

FIG. 1 is a plan view, partly broken away, of a preferred device embodying the invention, FIG. 2 a sectional view taken on the line II—II in FIG. 1, FIG. 3 a sectional view taken on the line III—III in FIG. 1, the device being connected with a combustion engine, FIG. 4 an electric circuit diagram of known type for the device shown in FIG. 1, FIG. 5 an enlarged sectional view of detail V of FIG. 1, FIG. 6 on a reduced scale an exploded, perspective view of the parts of the device shown in FIG. 5, FIG. 7 a variant of detail VII of FIG. 6, FIG. 8 on an enlarged scale detail VIII of FIG. 6 during the machining process, FIG. 9 an enlarged sectional view taken on the line IX—IX in FIG. 1, FIG. 10 on an enlarged scale detail X of FIG. 9 in the detached state, FIG. 11 on an enlarged scale detail XI of FIG. 3, FIG. 12 a basic diagram of FIG. 11, FIG. 13 a variant of the detail of FIG. 11, FIG. 14 a sectional view like FIG. 9 of a detail of a further developed embodiment of the device in accordance with the invention, FIG. 15 an exploded perspective view of the detail shown in FIG. 14, and FIG. 16 an exploded, perspective view of the detail XVI of FIG. 15.

The devices 1 of FIGS. 1 to 16 comprise each a frame plate 3 of cast or spray-cast aluminium. Two pairs of electro-magnets 2 are firmly secured by means of bolts 6 between the frame plate 3 and covers 4. Each of the electromagnets 2 comprises a core 10 formed by a packet of E-shaped magnet plates 5 and an energizing coil 14 around the core 10. Between every two alternately energized electro-magnets 2 is pivotally arranged a plate-shaped armature 18, which is slightly displaceable in its direction of length in a bearing 7. The bearing 7 is made from wear-resistant synthetic resin and has at the centre, on one side, a pin 9 loaded by a compression spring 8 and pushing the armature 18 against the opposite surface 36.

At the free end 15 each armature 18 has a coupling member 20, with which are connected two displacer bodies 22 of two fuel pumps 32. The stroke of the displacer bodies 22 is determined by a stop member 79 fastened to the associated coupling member 20 and co-operating with adjustable stops disposed one on each side thereof and formed by two wedges 26 and 33.

Each pump 32 comprises a pump chamber 29 having a fuel inlet 27 and a fuel outlet conduit 28, each of them leading to an atomizer 30 of a combustion engine 31. An inlet valve 39 and an outlet valve 41 are provided in a valve housing 43. All valve housings 43 are simultaneously connected in the pump housing 42 with an outlet manifold 500 made by spray casting, with which communicates each fuel outlet 501 of each fuel pump 32.

In a bridge piece 401, which bridges two fuel pumps 32, is provided for each fuel pump 32 a cylindrical pump sleeve 59.

In contrast to FIGS. 14 to 16, FIGS. 1 to 13 show that the pump chamber 29 is partly countersunk in a pump housing 42 comprising the valve housings 43. These pump housings 42 are pairwise disposed coaxially opposite one another, are rigidly secured to the frame plate 3 by means of bolts 458 and are provided with connecting nipples 502 forming part of an inlet manifold 503 and extending across the frame plate 3 into the fuel inlets 27, where they are sealed by means of O-rings 504. The supply manifold 503 is arranged between the frame plate 3 and a control-cylinder 73 forming part of the control-means, the fastening means of which formed by bolts 505 with cleats 506 secure, in addition, the inlet manifold 503 to the frame plate 3. The inlet manifold 503 has two connecting nipples 507 for the fuel supply duct 107 communicating with a fuel supply pump 40 and the fuel return duct 108. The return duct 108 communicates through a high-level channel 110 with the fuel inlet 27 of the two valve housings 43. Thus the fuel circulates in a large flow through the device 1, the fuel supply pump 40, the ducts 508 and the fuel tank 99 so that the fuel is not excessively heated in the device 1. Each valve housing 43 extends by its top end 509 into a bore 510 of the outlet manifold 500, where it is sealed by means of an O-ring 511, which is pressed home by tightening the fastening bolts 512. The outlet manifold 500 is connected on one and the same side with four fuel outlet ducts 28 communicating each with an atomizer 30 by means of a common fastening member 513, whose collars 566 extend in O-rings 515 of fuel outlet ducts 28. The fastening member 513 has a U-shaped profile and engages by ridges 516 grooves 517 of the outlet manifold 500. Each fuel outlet duct 28 consisting of a hose enveloped in metal tissue 563 is slipped onto the grooved end 565 of a nipple 564, which is subsequently locked by its collar 566 in an annular chamber 567 of the outlet manifold 500, where it is sealed by means of the O-ring 515. The fuel outlet duct 28 is intimately enclosed in a bore 569 of the fastening member 513 so that the elastic material penetrating into the grooves of the nipple 564 cannot disengage the same.

In all devices 1 of FIGS. 1 to 16 the displacer bodies 22 consist of a plunger 518 having a leading end 519 engaging the pump sleeve 59 and an axially extending sealing member 520, which is in sealing relationship at its cylindrical outer surface with the cylindrical pump chamber 29 by means of a stationary sealing ring 554 gripping around the cylindrical outer surface of the plunger 518 and having a U-shaped profile of elastic material, for example, rubber, or preferably of synthetic resin, whilst inside the same a metal circlip 555 is arranged, which pushes the two limbs 556 away from one another in order to establish a sealing relationship between said limbs 556 and a ring 557, in which the sealing ring 554 is arranged. In the axial direction the sealing ring 554 bears on a collar 558 of the ring 557, which is arranged with pressed fit in the bridge piece 401. A nodular cast-iron ring 559 is arranged with pressed fit, into which is inserted the sealing end 520 of the plunger 518.

At a low temperature the strongly shrunk sealing ring 554 provides a satisfactory seal, whereas even at a high temperature a perfect seal is obtained owing to the higher flexibility of the limb 556. The seal of the plungers 518 with respect to the associated pump chambers 29 is primarily maintained, since the free leading ends 519 of the plungers 518 are held in cylindrical supporting surfaces of the pump sleeves 59 and the sealing rings 554 engage the sealing members 520 located between the two rings 519 of the plungers 518.

The device 1 comprises two coupling members 20 and the displacer bodies 22 of each pair of fuel pumps 32 are intercoupled by means of one coupling member 20. Each coupling member 20 is coupled by means of an elastic coupling 66 with an armature 18. The displaced volume of each fuel pump 32 is determined by the stroke of the coupling member 20, which has a stop member 79 adapted to reciprocate between the wedges 26 and 33. The coupling member 20 together with the displacer bodies 22 constructed in the form of plungers and the stop member are manufactured as a monolith 38 of hard steel. The cylindrical stop member 79 is machined, for example, with an abrasive disc 45, whilst the previously machined displacer bodies 22 are arranged in grooves 521 of a rotatable claw head 37 and the monolith 38 is pressed home by means of a centering bit 44.

Referring to FIGS. 1 to 13, two housing assemblies 69 comprise each two integrally cast pump housings 42 of synthetic resin, between which wedges 26 and 33 are arranged to serve as common control-means for each of the pumps 32. A satisfactory seal of the plungers 518 is maintained because the leading ends 519 of the plungers 518 guided in the sleeves 59 absorb the tilting forces produced when the arm 79 strikes a wedge 26 or 33 outside the axis 85 of the sleeve 59.

In order to accurately align the cylindrical bores of the pairwise coaxial fuel pumps 32 in opposite relationship the pump sleeves 59 are arranged in coaxial, short bores 400 of a U-shaped bridge piece 401.

FIGS. 6 and 16 show that a first bridge piece 401 for accommodating a first pair of coaxial pump sleeves 59 and a second bridge piee 401 for accommodating a second pair of coaxial pump sleeves 50 form part of one and the same monolith 46. The monolith 46 comprises, apart from the said, relatively spaced bridge pieces 401, two fixed stop supports 48 interconnecting the ends 47 and supporting each an adjustable stop 33 and 26 respectively, conducting the same in a vertical sense. Since the stop supports 48 and the bridge pieces 401 form parts of one and the same monolith 46, the directions of the displacer bodies 22 and the stops 26 and 33 are firmly and accurately fixed relatively to one another. This accuracy can be readily obtained in a small, compact monolith 46. The fact that the shape of the monolith 46 is somewhat complicated is no objection and certainly so when it is made from fritted metal. Since the heavy impact forces of the stop member 79 on the stops 26 and 33 are absorbed in the monolith 46, the pump housings 42 may be made from synthetic resin (FIGS. 1 to 13) or they may be dispensed with (FIGS. 14 to 16). The monolith 46 is connected with the pump housings 42 in the embodiment shown in FIGS. 1 to 13. Two vertical extensions 49 formed on the stop supports 48 are in engagement with a surface located between two bridge pieces 401 in the pump housings 42. Since by using the bridge piece 401 the relative disposition of the pump housings 42 is unimportant, the pump housings 42 can be simply fastened to the frame plate 3 and be cheaply made, for example, from aluminium by spray casting. The pump chamber 29 comprises a pump compartment 532 protected against dirt by a filter 531 and accommodating the plunger 518 and a valve compartment 534 communicating with the former, protected against dirt by a further filter 533 and bounded by the inlet valve 39 and the outlet valve 41 in a valve housing 43 so that the vulnerable parts of the pump 32 are well protected. Each pump sleeve 59 is sealed by means of an O-ring 535 with respect to the pump housing 42.

Referring to FIGS. 1 to 16, the coaxial bores 400 have axial slots 527 on the side of the monolith 46, the width of said slots being such that the pump sleeves 59 can be inserted in a radial direction into the bores 401. Thus mounting is facilitated.

The wedge 26 is driven by a heavy piston 80 of a control-ram 73 communicating with the air inlet manifold 72 of the combustion engine 31 behind the air inlet valve 113. Outside the control-ram 73, at the end remote from the wedge 26, is arranged an axially displaceable switch 82, which is actuated by a hood-shaped cup spring 166 of the piston 80. The switch 82 cuts off the pumps 32 when the pressure in the inlet manifold 72 falls below a given value. The reset spring 167 is in engagement with the piston 80 through the hood-shaped cup spring 166 and a ball 168 located therein. The air chamber 528 of the control-ram 73 communicates through a duct 529 with the filter 530 of the air inlet manifold 72. The control-means for the adjustment of the volume of displacement of the pump chambers 29 comprise, apart from the wedge 26 with the control-ram 73, a wedge 33.

Referring to FIGS. 2, 3, 11 and 13 the wedge 33 has a control-pressure chamber 536, which communicates with the inlet manifold 72 of the combustion engine 31 through an opened valve 537, which is only opened at the release of the gas pedal 538 controlling the combustion engine 31 for reducing the amount of fuel pumped round by the fuel pumps 32. When the gas pedal 538 is actuated, the cable 560 draws down the valve member 561 against the action of a spring 562 into a closing position so that leaking air can fill out the control-pressure chamber 536. The control-pressure chamber 536 is bounded by a diaphragm 539, which is urged upwards by a spring 540 and which is connected with a sleeve 541. The wedge 33 is rotatable about a rod 545 having a shoulder 546, which is fixed in place in an axial direction with respect to the sleeve 541. The wedge 33 is held attracted by means of a plate magnet 50 against a nut 548, which is guarded against rotation and which is vertically displaced by rotation of the rod 545 for setting the stop 33 and hence the pump stroke. The stop 33 is adjusted in two ways independent of one another firstly by means of the pressure prevailing in the inlet manifold 72 and in the chamber 536 and secondly by means of a setting mechanism 51, which is coupled in the direction of rotation with the rod 545 through a catch 52 of square profile, but which is axially slidable with respect to said rod 545, since the catch 52 snaps into a matching cavity 53. An electric motor 595 of the setting mechanism 51 drives the catch 52 via a worm-wheel drive 598.

The basic diagram of FIG. 12 shows the control of the motor 595, which can be energized through the bridge circuit of four transistors 600 and two comparators 601 for driving in both directions. To the two comparators 601 are applied as input signals the measured-value signal derived from a measuring-value potentiometer 602 and respectively the setting-value signal derived from a setting-value potentiometer 603. The measuring-value potentiometer 602 is driven by the electric motor 595 and is, therefore, coupled with the drive of the wedge 33. The setting-value potentiometer 603 is actuated by an electric motor 611, which is controlled through an amplifier 612 and a combination network 613 by measuring members 614, which may be formed by a thermometer measuring the temperature of the combustion engine, a barometer, a CO-meter for assessing the $O_2$ percentage in the exhaust gases of the combustion engine and/or a measuring member measuring a different parameter.

The structure of the outlet manifold 500 and of the inlet manifold 503 of FIGS. 1 to 13 is shown in detail in FIG. 10. On the top side the inlet manifold 503 has a recess 570 joined by a nipple 571, which can be connected through a duct 572 with the inlet manifold 72 behind the choke valve 113. From the recess 570 the vacuum of the inlet manifold 72 is admitted through an aperture 574 and a filter 573 to above the piston 80 of the cylinder 73.

The monolith 46 is furthermore provided with aligning means for fixing the position of the stop support 48 with respect to the control-means i.e. the cylinder 73 for adjusting the stop 26. Referring to FIG. 6, these aligning means are formed by a pin 55 formed on the lower side, which thus forms part of the monolith 46 and which is in engagement with a matching bore 56 of the frame plate 3 with respect to which the control-ram 73 is positioned. The aligning means at the top are formed by lugs 57. The lower end 100 of the control-sleeve 58 is retained by said lugs 57 and a stop support 48 and thus aligned relatively to the stop support 48.

Each electro-magnet 2 is energized by means of a circuitry 170 shown in FIG. 4. An input $K_3$ receives a control-pulse from a pulse generator 34, which is coupled with the cam shift 163 of the motor 31. The pulse generator 34 has a rotatable contact 155, which alternately comes into contact with one of the four contacts 16 for the successive energisation of the electro-magnets 2. Each of these four contacts 16 is connected to an input terminal $K_3$ of one of four circuitries 170. In this way an atomizer 30 injects the fuel required for each combustion cylinder during each cycle of the combustion engine 31 at the required instant. The order of succession of the energisations of the electro-magnets 2 is chosen so that each of the wedges 26 and 33 is transiently released from a coupling member 20 during each cycle so that each of them can be displaced by a minor setting force. Between the accumulator 35 and the contact 155 is included the switch 82 so that upon a cut-off of the switch 82 no control-pulses are delivered.

The monolith 101 of FIG. 7 comprises a bridge piece 401 for accommodating the pump sleeves 59 of a first and a second fuel pump 32 and two integral stop supports 48 with extensions 49 and by means of positioning members formed by two projecting fitting pins 102 engaging two matching holes 103 it is positioned with respect to a second bridge piece 401 for accommodating the pump sleeves 59 of a third and a fourth fuel pump 32. However, the monolith 46 of FIG. 6 is preferred over the bipartite assembly of the bridge pieces of FIG. 7.

In the variant shown in FIG. 13 the wedge 33 is displaced against the action of a compression spring 540 by means of a diaphragm 539 when the pressure in the chamber 536 communicating with the inlet manifold 72 drops far below a given value. The minimum fuel displacement of the pump is adjusted by turning the finger knob 60, which screws the nut 61 upwards or downwards respectively in the housing 62. This screwing movement is performed stepwise, since a spring-loaded ball 63 snaps each time into a cavity 71 of the knob 60. The compression spring 64 urges down as far as possible the wedge 33 with respect to the sleeve 65 fastened to the diaphragm 539.

If it is desired to transiently supply an additional high amount of fuel to the combustion engine 31, for example, at a cold start, the wedge 33 cn be drawn upwards against the action of the spring 64 with the aid of a lever 67, which grips below a head 68 of the rod 70 of the wedge 33.

In a further developed device 1 embodying the invention the detail shown in FIGS. 14 to 16 differs from the corresponding detail of FIGS. 1 to 13. The device 1 of FIGS. 14 to 16 does not comprise a pump housing 42 connected with the monolith 46. The pump chamber 29 of each fuel pump 32 is solely bounded by a pump sleeve 59 arranged in a bore 400 of an end of a bridge piece and the displacer body 22 axially movable therein and constructed in the form of the plunger 518 and a seal provided by a circlip 555 between the pump sleeve 59 and the displacer body 22 and by a valve housing 43 clamped against the pump sleeve 59 by a thin, strongly compressed sealing ring 549 and having an inlet valve 39 and an outlet valve 41. The pump chamber 29 has in this way optimum rigidity so that at a rise in temperature of the pump 32 the displaced volume remains reproducibly fairly the same with a given setting of the wedges 26 and 33, since at an increased temperature the steel parts bounding the pump chamber 29 contrary to synthetic resin parts maintain their rigidity.

The omission of the synthetic pump housings 42 results in lower costs of the pump 32. The valve housings 43 are clamped pairwise against the associated pump sleeve 59 by means of a pressure plate 550 and a bolt 552 screwed into the monolith 46. Each valve housing 43 has, opposite the pressure plate 550, a vent hole 553 opening out in a flat surface 575, with which the pressure plate 550 is in sealing relationship via a thin sealing strip 551.

By unscrewing the bolt 552, which is readily accessible from the outside, two pump chambers 29 can be simultaneously vented.

Referring to FIGS. 14 to 16, the inlet valve 39 is located above the outlet valve 41 and the fuel is supplied from the top side. The valve housing 43 comprises three parts interfastened by press fit i.e. an inlet part 576 sealed by means of an O-ring 577 against creeping fuel and arranged in an intermediate part 578 enveloping a valve compartment 534 of the pump chamber 29 and accommodating the inlet valve 39 loaded by a compression spring 579 in sealing relationship with the inlet part 576 having the function of a valve seat. The intermediate part 578 serves as a valve seat for an outlet valve 41 loaded by a compression spring 580 and accommodated in an outlet part 581, in which the intermediate part 578 is accommodated with press fit together with an O-ring 582 in sealing relationship. Each valve housing 43 is sealingly arranged by means of ends provided with O-rings 583 in a supply manifold 503 and an outlet manifold 500, each made of synthetic resin.

The inlet part 576 has a large bore 584 in order for any vapour bubbles formed in a stationary, hot combustion engine to escape upwards rather than entering the pump chamber 29 so that by the circulation indicated by the arrows 585 of the fuel in the inlet manifold 503 they are conveyed to the fuel tank 99. In the outlet manifold 500 four parallel channels 586 connect each a valve housing 43 with a fuel outlet duct 28, which is fastened by means of a nipple 507 and a sealing ring 515 and a common impingment plate 587 by two bolts 588 to the outlet manifold 500.

With the interposition of a flexible air filter 74 the control-ram 73 is fastened by means of bolts 505 and clamps 506 to a cylinder cover 75 formed by an accurately manufactured monolith of fritted material 77 having two upwardly extending projections 78 having each two fitting pins 76, which are fastened lock-tight in bores 81 accurately positioned and orientated in the lower side of the monolith 46. The outlet manifold 500 and the frame plate 3 are arranged between the monoliths 46 and 77. Since the monolith 77 has an accurately positioned and orientated, annular recess 83 for centrally receiving the upper edge 84 of the control-ram 73, this control-ram 73 and particularly the piston rod 86 thereof, carrying the wedge 26, is accurately orientated with respect to the associated stop support 48. The stop support 48 is provided with a strip 87 of synthetic resin, whose broader upper and lower rims 88 are arranged in slots 89 of the monolith 46. Also owing to the accurate alignment of the control-ram 73 with respect to the associated stop support 48 each small pressure variation in the air inlet manifold 72 is capable of readjusting the wedge 26.

The bridge piece 401 is fastened to the frame plate 3 by means of a centering pin 55 of the monolith 46, which puts into a matching hole of the frame plate 3 and by means of a bolt 23.

The wedge 33 can be adjusted as follows, as is shown in FIG. 14.

The screwthreaded rod 545 can be urged upwards by means of a draw cable 90 engaging a lever 91 in order to increase the amount of fuel during the start of the combustion engine. An electro-magnet 12 can move down its armature 13 against a compression spring, when energized during stationary operation of the combustion engine 31, as a result of which the fuel displacement is reduced.

The wedge 33 can furthermore be adjusted with respect to the rod 545 by turning the rod 545 so that the nut 548 guarded against rotation is axially displaced and hence also the wedge 33, which is urged against it by a spring 64. The rod 545 is turned by means of a thumbwheel 24, which is actuated from the driver seat of a car in accordance with traffic conditions in order to save fuel. On an uninterrupted road without ground level crossings and in particular during travel at cruising speed and, more particularly, when travelling under any "cruise control" the fuel-air mixture in the combustion engine 31 is kept as lean as possible. For this purpose the wedge 33 is moved downwards. In contrast a richer fuel-air mixture is set for urban traffic. The transmission is performed from the thumbwheel 24 via a torsion-free cable 25 and a pinion drive 26, which drives the rod 545 through an axial slide coupling 93. In order to identify the position of the wedge 33 an indicator 92 is arranged near the thumbwheel 24.

Preferably this finger adjustment of the wedge 33 is combined with an automatic wedge setting, which receives, for example, from a "cruise control" system, a signal depending, for example, upon an actuation of the brake pedal, by which the wedge setting obtained by the thumbwheel 24 for a lean mixture is suppressed. The setting of the wedge 33 for stationary running depends upon the rotational position of the screw sleeve shaped armature 13 with respect to a screw sleeve 19.

What I claim is:

1. A device for distributing fuel to a combustion engine, in which a pump chamber of a first fuel pump and a pump chamber of a second fuel pump are arranged coaxially at a distance from one another, can each be connected through an inlet valve with a fuel inlet and through a fuel outlet with an atomizer of the combustion engine and are bounded by a displacer body reciprocatorily driven by driving means, the displacer bodies being intercoupled by means of a coupling member arranged between the two fuel pumps and having stop means co-operating with at least one adjustable stop, which bears on a fixed stop support, the fuel chambers being bounded by pump sleeves arranged in coaxial bores in the two ends of a bridge piece, the two ends of which are interconnected by at least one intermediate piece, characterized in that the bridge piece and the fixed stop support are integral so as to form part of one and the same monolith, said monolith being provided with aligning means for fixing the position of the stop support with respect to control-means for setting the stop.

2. A device as claimed in claim 1, characterized in that the monolith is made from fritted metal.

3. A device for distributing fuel to a combustion engine, in which a pump chamber of a first fuel pump and a pump chamber of a second fuel pump are arranged coaxially at a distance from one another, can each be connected through an inlet valve with a fuel inlet and through a fuel outlet with an atomizer of the combustion engine and are bounded by a displacer body reciprocatorily driven by driving means, the displacer bodies being intercoupled by means of a coupling member arranged between the two fuel pumps and having stop means co-operating with at least one adjustable stop, which bears on a fixed stop support, the fuel chambers being bounded by pump sleeves arranged in coaxial bores in the two ends of a bridge piece, the two ends of which are interconnected by at least one intermediate piece, characterized in that the bridge piece and the fixed stop support are integral so as to form part of one and the same monolith, the inlet valve of each fuel pump being above the outlet valve thereof.

4. A device as claimed in claim 3, characterized in that the monolith is made from fritted metal.

5. A device as claimed in anyone of claims 1–4, characterized in that a first bridge piece for the disposition of a first pair of coaxial pump sleeves and a second bridge piece for the disposition of a second pair of coaxial pump sleeves therein form part of one and the same monolith.

6. A device as claimed in anyone of claims 1–4, characterized in that the coaxial bores have each on one side an axial slot for passing in a radial direction the displacer bodies during mounting, the width of said axial slots being preferably such that the pump sleeves can be placed in a radial direction in the coaxial bores.

7. A device as claimed in anyone of claims 1–4, characterized in that the monolith comprises two relatively spaced bridge pieces and two stop supports interconnecting the ends of the bridge pieces.

8. A device as claimed in anyone of claims 1–4, characterized in that at least one coupling member together with two displacer bodies constructed in the form of plungers and a, preferably, cylindrical stop member forming the stop means are made in the form of a monolith of hard steel.

9. A device as claimed in anyone of claims 1–4, characterized in that at least one adjustable stop engages a fixed stop support through a strip of synthetic resin connected with the monolith.

10. A device as claimed in anyone of claims 1–4, characterized in that the pump chamber of each fuel pump is solely bounded by a pump sleeve accommodated in an end of a bridge piece with the displacer body movable therein and with a seal between said pump sleeve and the displacer body and by a valve housing sealingly clamped to the pump sleeve, said housing having an inlet valve and an outlet valve.

11. A device as claimed in anyone of claims 1–4, characterized in that an adjustable stop can be set by means of a control-element provided with an indicator and actuable from the driver seat of an automobile.

* * * * *